US006121929A

United States Patent [19]

Olson et al.

[11] Patent Number: 6,121,929

[45] Date of Patent: Sep. 19, 2000

[54] ANTENNA SYSTEM

[75] Inventors: Steven Carter Olson, Broomfield; Jeffrey Allan Godard, Littleton, both of Colo.

[73] Assignee: Ball Aerospace & Technologies Corp., Boulder, Colo.

[21] Appl. No.: 08/884,865

[22] Filed: Jun. 30, 1997

[51] Int. Cl.[7] ..... H01Q 1/38

[52] U.S. Cl. ..... 343/700

[58] Field of Search ..... 343/700 MS, 795, 343/797; H01Q 1/38, 9/00

[56] References Cited

U.S. PATENT DOCUMENTS

| | | | |
|---|---|---|---|
| 2,551,664 | 5/1951 | Galper | 343/741 |
| 3,475,758 | 10/1969 | DeVito | 343/795 |
| 3,969,730 | 7/1976 | Fuchser | 343/770 |
| 4,464,663 | 8/1984 | Lalezari et al. | 343/700 MS |
| 4,498,085 | 2/1985 | Schwarzmann | 343/795 |
| 4,724,443 | 2/1988 | Nysen | 343/700 MS |
| 4,761,653 | 8/1988 | Owens et al. | 343/700 MS |
| 4,914,445 | 4/1990 | Shoemaker | 343/700 MS |
| 4,937,585 | 6/1990 | Shoemaker | 343/700 MS |
| 5,061,943 | 10/1991 | Rammos | 343/770 |
| 5,124,733 | 6/1992 | Haneishi | 343/700 MS |
| 5,172,128 | 12/1992 | Bouko et al. | 343/795 |
| 5,307,075 | 4/1994 | Huynh | 343/700 MS |
| 5,559,523 | 9/1996 | Smith et al. | 343/795 |
| 5,572,222 | 11/1996 | Mailandt et al. | 343/700 MS |
| 5,717,407 | 2/1998 | Hong | 343/700 MS |
| 5,760,741 | 6/1998 | Huynh et al. | 343/700 MS |
| 5,796,367 | 8/1998 | Andersson | 343/700 MS |

*Primary Examiner*—Michael C. Wimer
*Attorney, Agent, or Firm*—Sheridan Ross P.C.

[57] ABSTRACT

The present invention relates to an antenna system that is particularly suited for use in communications systems implementing wireless local loops. In its preferred embodiment, the antenna comprises an array of air loaded stacked patch antenna elements suspended above a ground plane. The antennas each operate in a dual slant 45 linearly polarized mode and are fed by air loaded microstrip transmission line feeds. The line widths of the feed lines are uniform throughout the design, thereby eliminating the need for impedance transformers. The electronics for the antenna is located beneath the antenna ground plane to reduce the footprint of the antenna. In addition, a "connectorless" coupling structure is provided for transferring signals between the antenna elements and the underlying electronics. In one embodiment, an antenna is provided having enhanced sidelobe suppression despite having a limited number of side by side elements in a plane of interest.

8 Claims, 13 Drawing Sheets

View Y - Y'

View X - X'

View C - C'

ANTENNA SYSTEM

FIELD OF THE INVENTION

The present invention relates generally to antenna systems and is particularly apt for use in wireless communications applications.

BACKGROUND OF THE INVENTION

In a telephone communications system, the local loop is the connection between the customer premises and the switch in the local exchange. In the past, local loops were predominantly wired connections. Today, wireless local loops are increasing in popularity because of their wider bandwidths and increased flexibility.

To implement a communications system using wireless local loops, a multitude of wireless local loop base stations must be provided. Each base station services a predetermined number of customers in a given area. In one system, for example, each base station services 2000 customers. To use the system, each customer premises serviced by a particular local loop base station has to be fitted with a local loop antenna and transmit/receive circuitry to communicate with the base station. The local loop antenna would be mounted, for example, on an exterior wall of the customer premises and would be pointing in the general direction of the appropriate base station.

It is not inconceivable that a large percentage of the telephone users in the United States and around the world could someday be serviced by wireless local loops. This will require the production of millions of local loop antennas. Because the number of required antennas is so large, it is important that the antennas be relatively inexpensive to manufacture. That is, a small cost savings per antenna can add up to a very large savings by the time the millionth antenna is produced. Cost cutting, however, should not compromise the performance characteristics of the antenna or greatly reduce the structural integrity of the antenna.

Another consideration for local loop antennas, in general, is sidelobe suppression. Sidelobes are undesirable because they can cause interference with neighboring base stations or other transmit/receive equipment in the area. To achieve a given level of sidelobe suppression in an array antenna, amplitude tapering is generally employed. That is, the elements within the rows and/or columns of the array are driven at different excitation levels, with the excitation level at the center of a particular row or column being greater than the excitation levels toward the ends of the row or column. Such amplitude tapering reduces the sidelobe levels in a plane including the tapered row or column.

Theoretically, perfect sidelobe suppression can be achieved if an ideal binomial taper is used. An ideal binomial taper has an excitation profile that includes a peak center excitation level and geometrically decreasing side excitation levels that fall off by a factor of one-half for each successive element. For example, one such excitation profile is {a, 2a, 4a, 2a, a}. Non-ideal excitation profiles will produce sidelobe suppression of various degrees.

Because the size of a local loop antenna is normally limited, there is not always enough space to implement the number of elements required to achieve a desired level of sidelobe suppression. That is, an antenna may only be able to fit two side by side elements in a particular sidelobe plane, while three or more elements would be required to achieve a desired level of sidelobe suppression. It would be advantageous to be able to achieve a desired level of sidelobe suppression despite the limited number of elements in the plane of interest. In addition, amplitude tapering generally requires the use of unequal power splits to achieve the required excitation levels. These unequal power splits are difficult to implement and are generally lossy. It would be advantageous to develop a method for achieving a particular excitation profile without using unequal power splits.

SUMMARY OF THE INVENTION

The present invention relates to a low cost, high performance antenna for use in communications systems having a wireless local loop and in other high volume antenna applications. The antenna of the present invention is quick and easy to manufacture and thereby significantly reduces labor costs. In addition, the antenna has a relatively low part count and uses commonly available, inexpensive materials. The antenna is compact, lightweight and structurally sound and provides the low loss/high gain performance required in wireless local loop communications applications. In one embodiment, the antenna provides enhanced sidelobe suppression despite having a limited number of side by side elements in a plane of interest.

DETAILED DESCRIPTION OF THE PREFERRED EMBODIMENT

The present invention relates to an antenna system that is particularly suited for use in communications systems implementing wireless local loops. In its preferred embodiment, the antenna comprises an array of air loaded stacked patch antenna elements suspended above a ground plane. The antennas each operate in a dual slant 45 linearly polarized mode and are fed by air loaded microstrip transmission line feeds. The line widths of the feed lines are substantially uniform and the use of impedance transformers is eliminated. The electronics for the antenna is located on a circuit board beneath the antenna ground plane to reduce the footprint of the antenna. In addition, a novel "connectorless" coupling structure is provided for transferring signals between the antenna elements and the underlying electronics.

Figure 1:
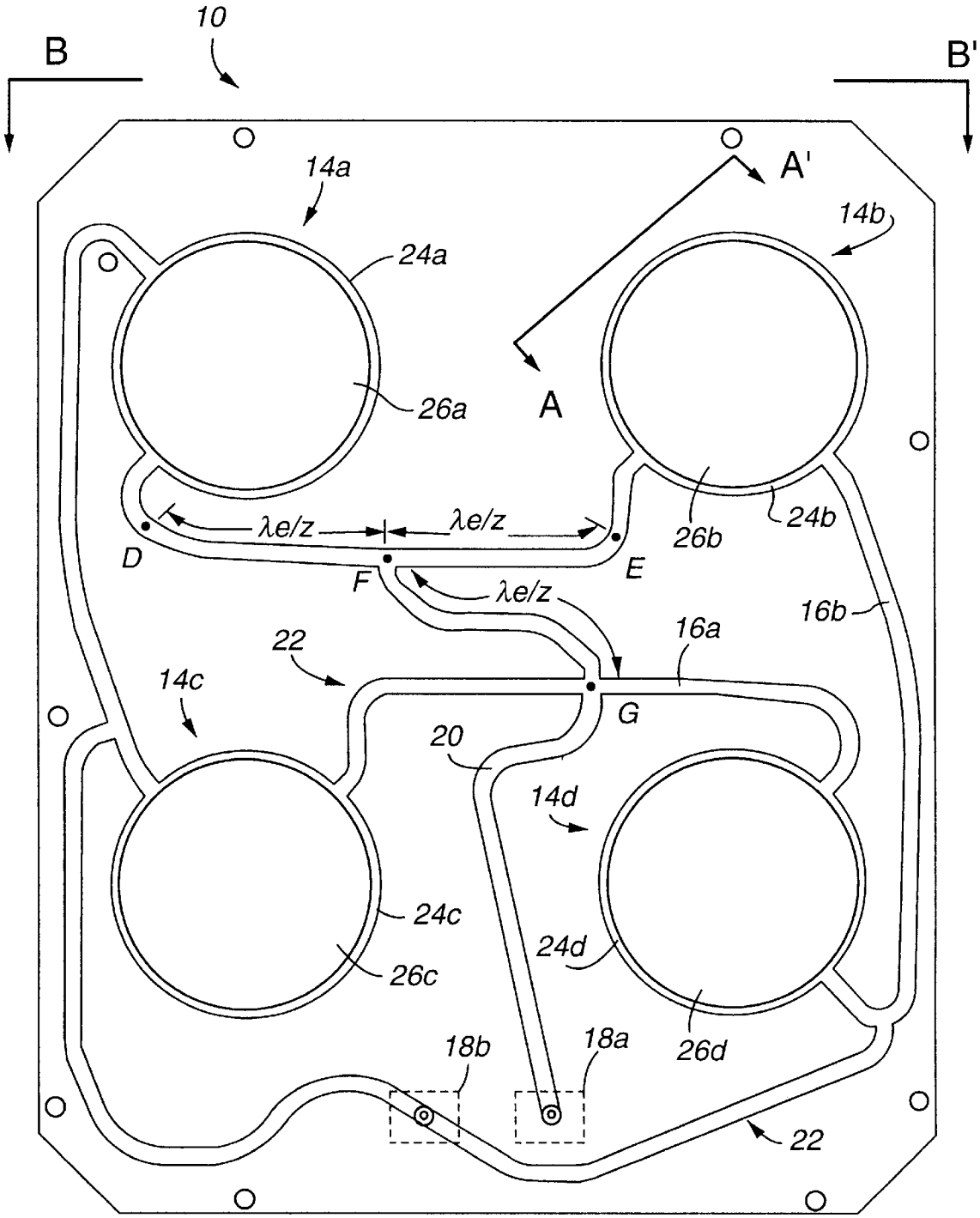
FIG. 1 is a top view of an antenna system in accordance with the present invention.

FIG. 1 is a top view of an antenna system 10 in accordance with the present invention. The antenna system 10 includes: a ground plane 12, a plurality of "stacked patch" antenna elements 14*a*–14*d*, first and second feed structures 16*a*, 16*b*, and first and second radio frequency connectors 18*a*, 18*b*. The ground plane 12 is preferably made of sheet aluminum and has a size and shape dictated by the particular application. The antenna elements 14*a*–14*d* are operative for transmitting and/or receiving radio frequency energy to/from free space. The feed structures 16*a*, 16*b* are operative for transferring radio frequency energy between the antenna elements 14*a*–14*d* and the connectors 18*a*, 18*b*. The feed structures 16*a*, 16*b* also act as divider/combiners. The connectors 18*a*, 18*b* are for use in coupling radio frequency energy between the feed structures 16 *a*, 16*b* and electronic circuitry (not shown) located below the ground plane 12.

Figure 2:
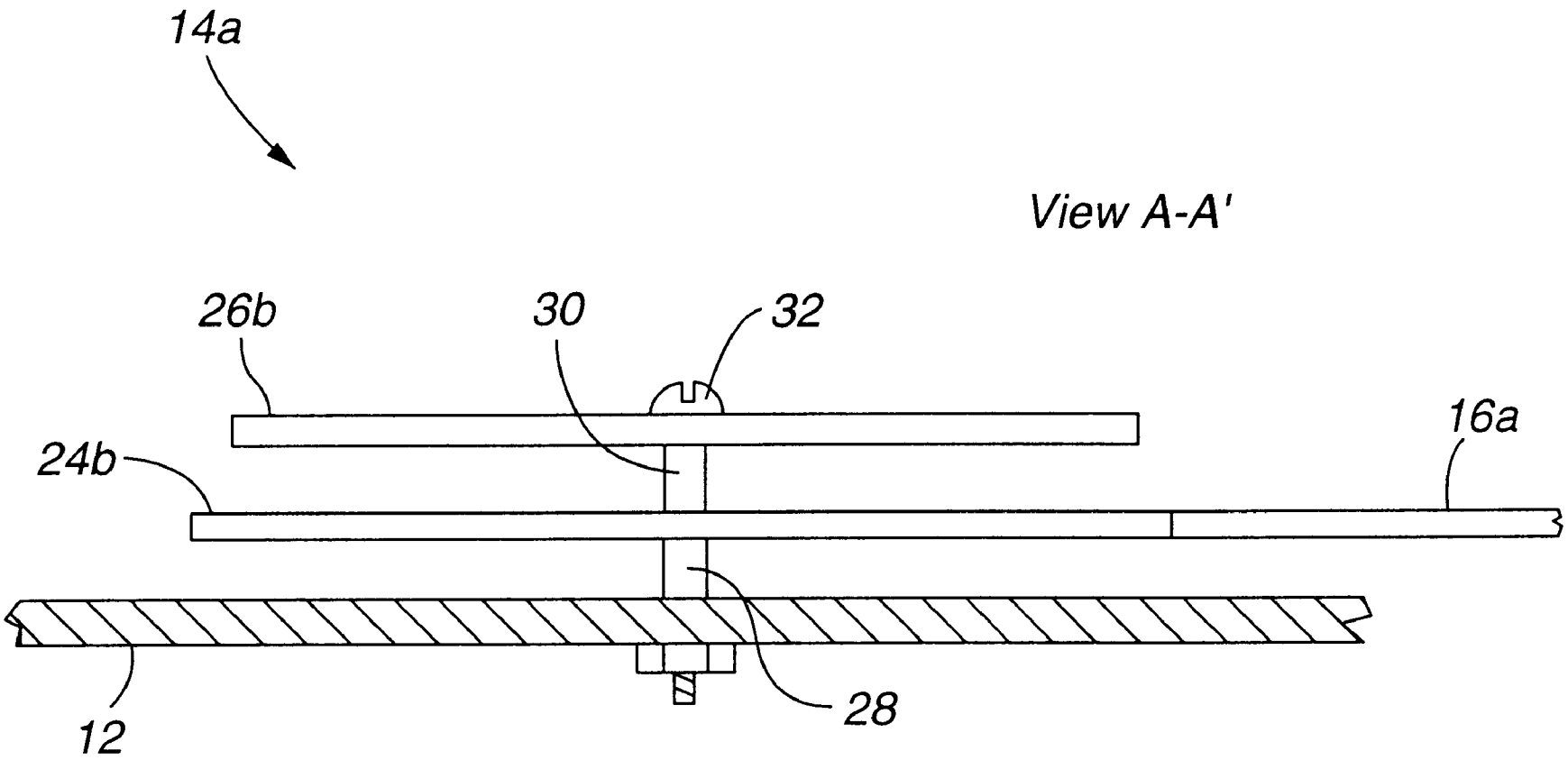
FIG. 2 is a sectional side view of a "stacked patch" antenna element in accordance with the present invention.

FIG. 2 is a side view of the "stacked patch" antenna element 14*b* illustrating the structure of the element. The view corresponds to view A–A' illustrated in FIG. 1. As shown, the antenna element 14*b* includes a lower conductive plate 24*b* and an upper conductive plate 26*b*. A circular shape was chosen for the upper conductive plate 26*b* because this eliminates the need to accurately position the plate rotationally about a center axis. It should be appreciated, however, that any orthogonally symmetric shape (such as octagonal, square, etc.) can be used in accordance with the present invention. Furthermore, the shape of the lower plate 24*b* can be different from the shape of the upper plate 26*b*.

The lower plate 24 is suspended above the ground plane 12 using a first spacer 28. Similarly, the upper plate 26 is suspended above the lower plate 24 using a second spacer 30. The entire assembly is held together using a fastener 32, which in the illustrated embodiment includes a screw and nut. Other fastener types can also be used, such as clips and PEM studs. In a preferred embodiment of the present invention, snap together element construction is implemented. For example, in one approach, a post is "snapped" into a hole in the ground plane. The post has resilient compression members and support members that conform to the hole in the ground plane 12 and hold the post in a vertical position with respect to the ground plane 12. A first spacer is then slipped over the post and the lower plate is placed over the first spacer. A second spacer is then placed over the post and the upper plate is placed over the second spacer. A snap-on or compression fitting is then placed at the top end of the post to hold the assembly together. This arrangement greatly reduces antenna assembly time.

The lower conductive plates 24*a*–24*d* of the antenna elements 14*a*–14*d* can be either directly or capacitively connected to the two feed structures 16 *a*, 16*b*. Each upper conductive plate 26 *a*–26*d* can be either conductively coupled or isolated from its corresponding lower plate 24*a*–24*d*. If the stacked patch antenna elements 14*a*–14*d* are being used in a transmit mode, a radio frequency signal is delivered to each lower plate 24*a*–24*d* (i.e., the driven plate), via the feed structures 16*a*, 16*b*, which produces currents on the lower plates 24*a*–24*d*. The currents on the lower plates 24*a*–24*b*, in turn, create fields around the lower plates 24*a*–24*d* that induce currents on the upper plates 26*a*–26*d* (i.e., the parasitic plates). The fields created by the currents on both the upper and lower plates then combine in the far-field to create a relatively high-gain antenna transmit beam in a direction perpendicular to the plane of the plates. If the stacked patch elements 14*a*–14*d* are being used in a receive mode, operation is substantially the reverse of the above. In general, either the upper plates 26*a*–26*d* or the lower plates 24*a*–24*d* can operate as the driven plates. In addition, further plates can be added to the stacked patch structure to obtain additional control over the impedance and bandwidth, as well as the far-field pattern of the elements 14*a*–14*d*.

In a preferred embodiment of the present invention, all four of the lower plates 24*a*–24*d* and all of the first and second feed structures 16*a*, 16*b* are constructed from a single sheet of conductive material. This single "driver circuit layer" 22 can be stamped, for example, from a single piece of sheet aluminum. Use of this single driver circuit layer 22 reduces antenna assembly time because only one piece has to be set in place during construction and few, if any, solder connections need to be made. If a "snap together" construction is implemented, the entire driver circuit layer 22 can be set in place in less than one second.

As illustrated in FIG. 1, the line widths of the transmission lines within the feed structures 16*a*, 16*b* are uniform throughout the design. In the preferred embodiment, the characteristic impedance of the transmission lines of the feed structures 16*a*, 16*b* are nominally 100 ohms. Uniform line widths were used to eliminate impedance transformers in the antenna, as these transformers usually introduce loss into the system. To achieve uniform line widths, a series of half wavelength transmission line sections (i.e., sections having an electrical length of 180 degrees) is implemented. With a half wavelength section, the input impedance is substantially equal to the output impedance, regardless of the characteristic impedance of the line. This attribute was used as follows to achieve uniform line widths.

With reference to FIG. 1, the impedance looking into antenna element 14*a* from point D is approximately 200 ohms. Similarly, the impedance looking onto element 14*b* from point E is approximately 200 ohms. Point F is one half effective wavelength from both points D and E. Therefore, point F sees an impedance of 200 ohms looking toward point D or looking toward point E. This creates a parallel combination that results in an overall impedance at point F of 100 ohms. The distance between point F and point G is also one half effective wavelength so the impedance at point G looking back at point F is 100 ohms regardless of the intervening line width. Point G is identical with respect to elements 14*c* and 14*d* as point F is with respect to elements 14*a* and 14*b* and, therefore, point G sees an impedance of 200 ohms looking toward either element 14*c* or 14*d*. The three way parallel combination at point G results in an overall impedance of 50 ohms at this point. The electrical length of line 20 is 180 degrees which ensures that the connector 18*a* sees 50 ohms when looking into the circuit. Similar techniques were used in designing the feed structure 16*b* which also does not require impedance transformers. The line widths of the feed structures 16*a*, 16*b* were chosen based on a tradeoff between manufacturing tolerance concerns and potential line radiation problems.

Figure 3A:
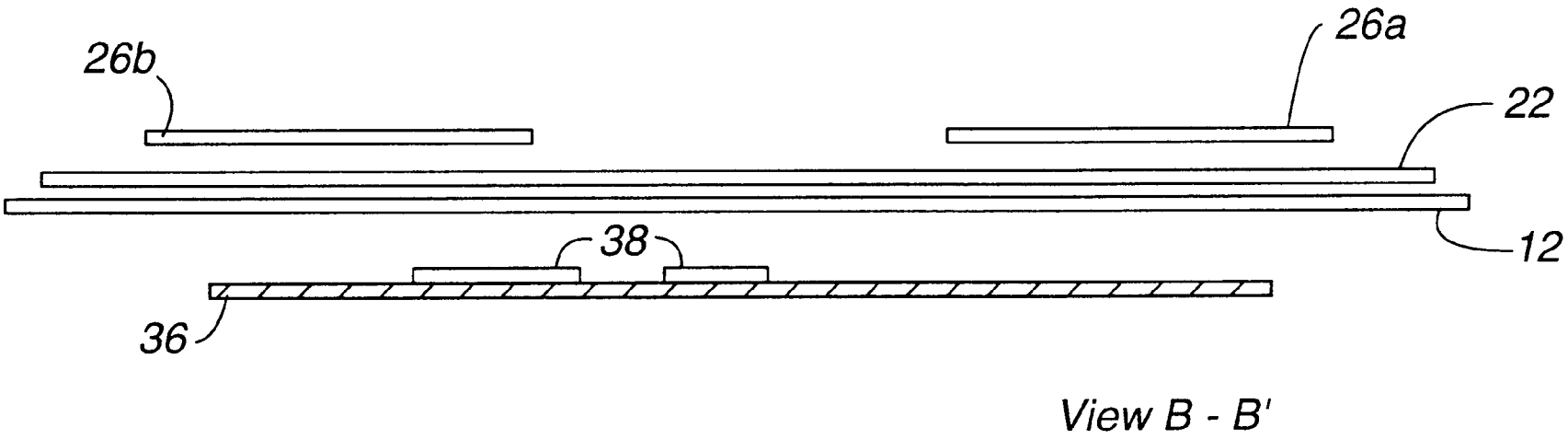
FIGS. 3*a* and 3*b* are sectional side views of the antenna system of FIG. 1 disposed within a housing.

FIG. 3*a* is a side view of the antenna system 10 corresponding to view B–B' illustrated in FIG. 1. FIG. 3*a* illustrates the various layers of the antenna system 10 and their relationship to one another in one embodiment of the present invention. As illustrated in FIG. 3*a*, the upper conductive plates 26*a*, 26*b* are suspended above the driver circuit layer 22. The driver circuit layer 22 is likewise suspended above the ground plane 12. Nominal line widths of 0.225 are used with a nominal spacing between the driver circuit layer 22 and the ground plane of 0.160 inches. A circuit board 36 containing transmit/receive electronics 38 is disposed below the antenna system 10. As discussed previously, the connectors 18*a*, 18*b* are used to couple radio frequency energy from the antenna system 10 to the underlying electronics 38. As will be described shortly, an alternative "connectorless" coupling structure in accordance with the present invention can be implemented in place of the connectors 18*a*, 18*b* for transferring signals between the electronics and the antenna circuitry.

Figure 3B:
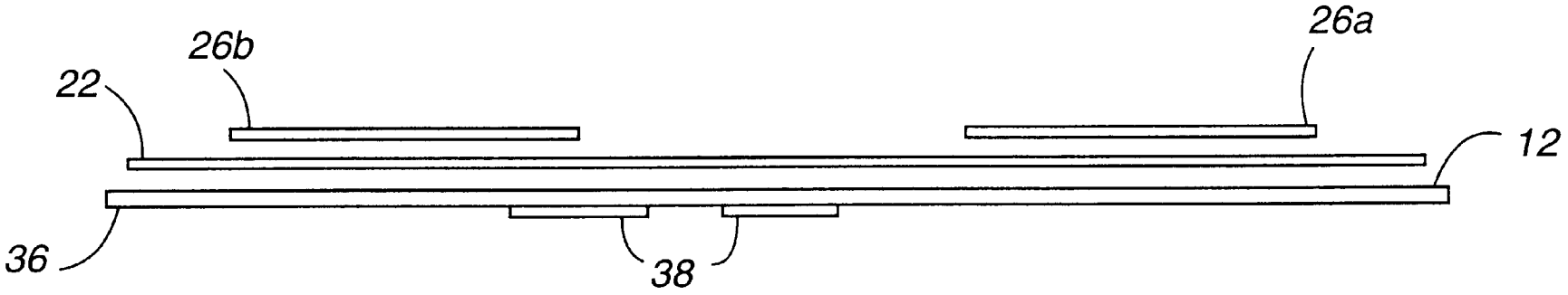

In one embodiment of the present invention, as illustrated in FIG. 3*b*, the groundplane surface of the circuit board 36 (i.e., the surface opposite the surface carrying the electronics) is used as the groundplane 12 of the antenna system 10. This reduces the overall size of the antenna system and also simplifies construction. It also facilitates the implementation of connectorless coupling structures.

Figure 4A:
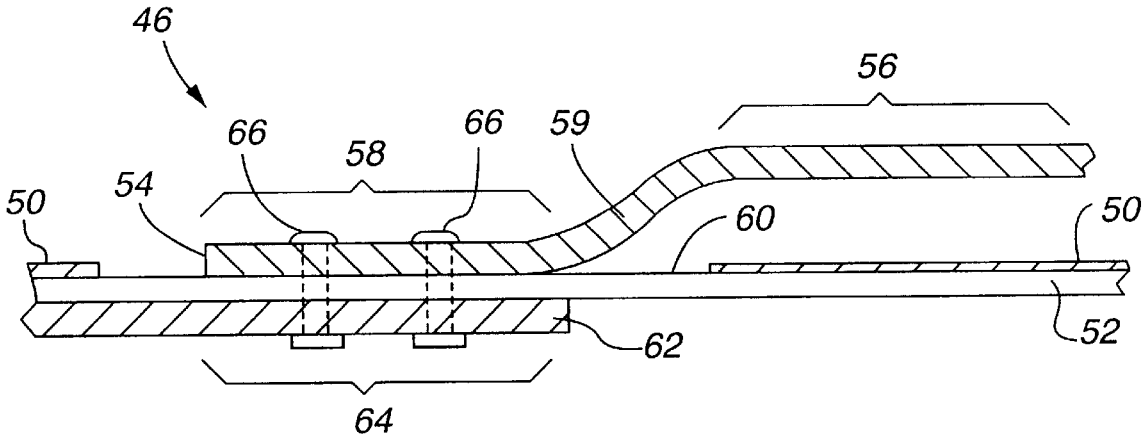
FIGS. 4*a* and 4*b* are a side view and a top view, respectively, of a connectorless transition in accordance with the present invention.
Figure 4B:
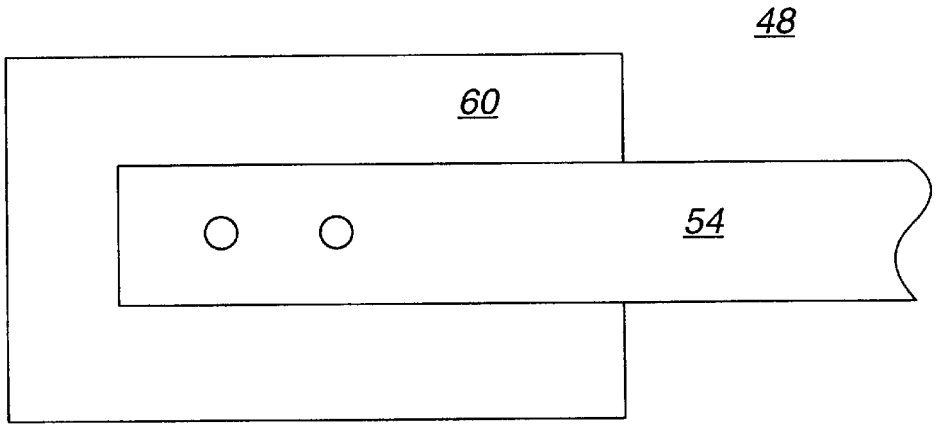
Figure 6A:
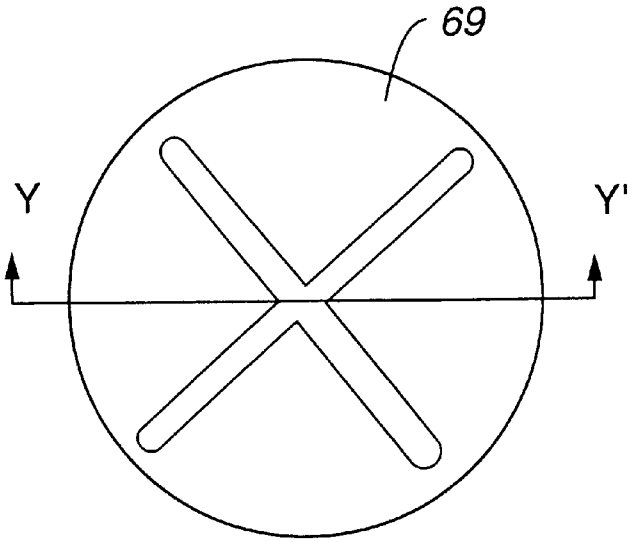
FIGS. 5*a*, 5*b*, 6 *a*, and 6*b* are various views illustrating two different techniques for working a patch element to increase the structural rigidity thereof.
Figure 6B:
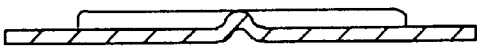
Figure 5A:
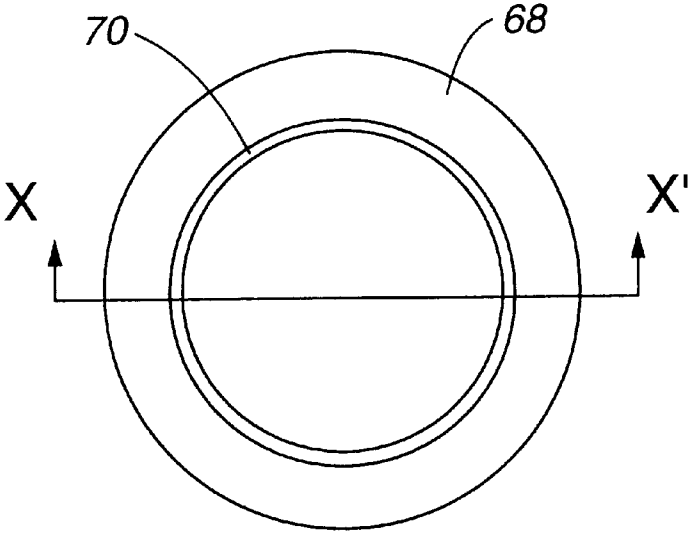
Figure 5B:
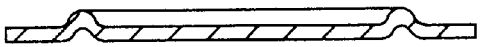

FIGS. 4*a* and 4*b* are a sectional side view and a top view, respectively, illustrating a connectorless transition 46 in * accordance with the present invention. The connectorless transition 46 includes a dielectric circuit board 52 having a metallic ground plane 50 disposed upon an upper surface. Above the circuit board 52 is a transmission line center conductor 54 for carrying radio frequency signals. A first portion 56 of the center conductor 54 is raised above the ground plane 50 and acts as the center conductor of an air-loaded microstrip transmission line, such as those used in the feed structures 16*a*, 16*b* of antenna system 10. A second portion 58 of the center conductor 54 is disposed in contact with the circuit board 52 in a region 60 where the ground plane 50 has been removed. The center conductor 54 includes a bent portion 59 connecting the first and second portions 56, 58.

On the underside of circuit board 52 is a second transmission line center conductor 62. The second transmission line center conductor 62 has an end portion 64 disposed directly beneath the second portion 58 of the first transmission line center conductor 56 and coupled therewith. In a preferred embodiment, the length of overlap of the two center conductors is approximately one quarter wavelength at the frequency of interest, to maximize coupling. The second center conductor 62 can be part of a microstrip, stripline, or other transmission medium on the underside of the circuit board 52.

The connectorless transition 46 can be implemented in the system illustrated in FIG. 3*b*. The circuitry 38 can be directly connected to the second center conductor 62. Processes, such as chemical etching, can be used to create the required metallization patterns on the upper and lower surfaces of circuit board 36. The first center conductor 54 would be part of the driver circuit layer 22 that includes both the feed structures 16*a*, 16*b* and the lower conductive plates 24*a*–24*d*. The bent portion 59 of the center conductor 54 can be created in the same stamping process that cuts the driver circuit layer 22 from the conductive sheet material.

To assemble the connectorless transition 46, the second portion 58 of the center conductor 54 is positioned over the region 60 having no ground plane. Through holes in the second portion 58 are then aligned with through holes in the circuit board 52. Fasteners 66 are then inserted into the through holes and secured to lock the center conductor 54 to the circuit board 52 in the coupling region. Alternatively, other methods can be used to secure the center conductor 54 in the coupling region. For example, an adhesive or double sided tape can be used. Also, the second portion 58 can be held against the circuit board by the inherent spring force of the center conductor 54. In another approach, a metallization layer can be etched in the coupling region and the center conductor 54 can be soldered, welded, or glued (using a conductive adhesive) thereto.

As discussed above, in a preferred embodiment of the present invention, most of the conductive members are constructed from sheet aluminum. Sheet aluminum was chosen because it is relatively low in cost, has a relatively high strength/weight ratio, is relatively easy to work, and is very rigid. As sheet aluminum is generally sold by the pound, it was determined that the cost per antenna could be reduced by reducing the amount of aluminum (i.e., reduce the thickness of the aluminum plate) used in each antenna. The problem this created, however, was that the structural rigidity of the antenna was reduced as the thickness of the aluminum plate was reduced. In conceiving of the present invention, it was appreciated that some of the rigidity that is lost by reducing the thickness of the sheet could be regained by working the sheet materials. That is, by creating, for example, "ridges" and "grooves" in the sheets, an enhanced structural rigidity can be achieved with less material.

FIGS. 5*a*, 5*b*, 6*a*, and 6*b* illustrate two circular microstrip patch antenna elements 68, 69 in accordance with the present invention. The patch 68 of FIGS. 5*a* and 5*b* includes a single, concentric ridge 70 to add structural rigidity. The ridge can be produced in the same stamping step that cuts the patch from an aluminum sheet. Additional concentric ridges can also be provided for added rigidity. The element 69 of FIGS. 6*a* and 6*b* includes a raised "X" section for added rigidity. By adding ridges to the patch elements, aluminum sheet materials having a thickness of 0.030 inches and below can be used in the antenna system 10. The strengthening ridges can be used for the patches 14*a*–14*d* and the feed lines 16*a*, 16*b* of FIG. 1.

Figure 7A:
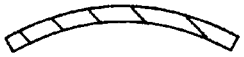
FIGS. 7*a*–7*g* illustrate various techniques for working a transmission line center conductor to increase the structural rigidity thereof.
Figure 7B:
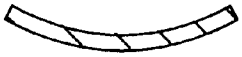
Figure 7C:
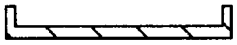
Figure 7D:
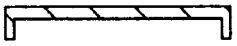
Figure 7E:
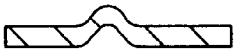
Figure 7F:
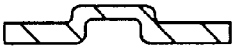
Figure 7G:
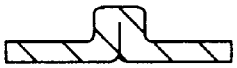

FIGS. 7*a*–7*g* are cross sections of transmission line center conductors illustrating various ways of working the center conductors to increase the structural rigidity thereof. For example, FIGS. 7*a* and 7*b* show a slight curving of the center conductors. FIGS. 7*c* and 7*d* show 90 degree bends at the edges of the center conductors. FIGS. 7*e*, 7*f*, and 7*g* illustrate various ridge/groove approaches.

Figure 8:
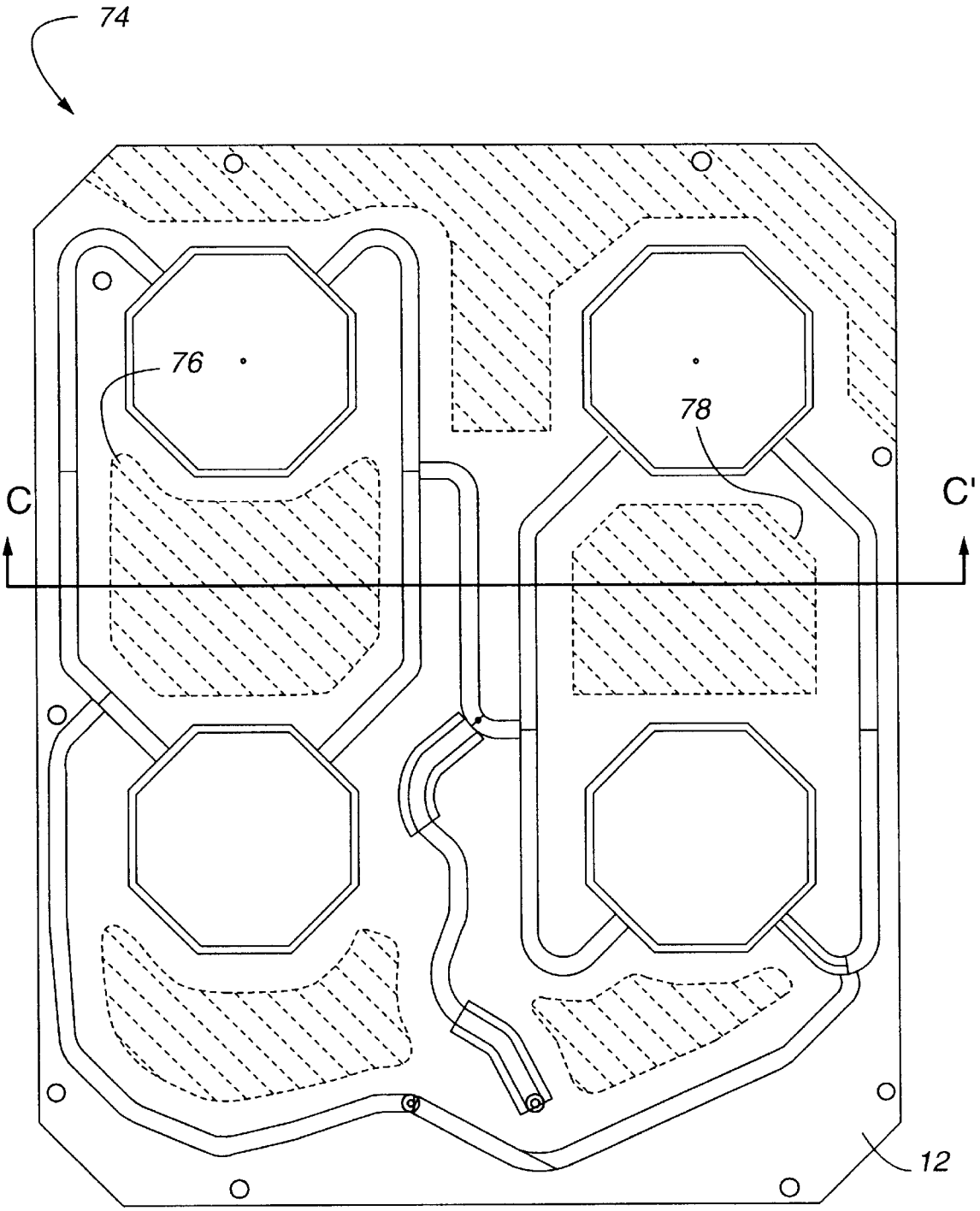
FIGS. 8 and 9 are a top view and a sectional side view, respectively, illustrating a technique for increasing the structural rigidity of a ground plane.
Figure 9:
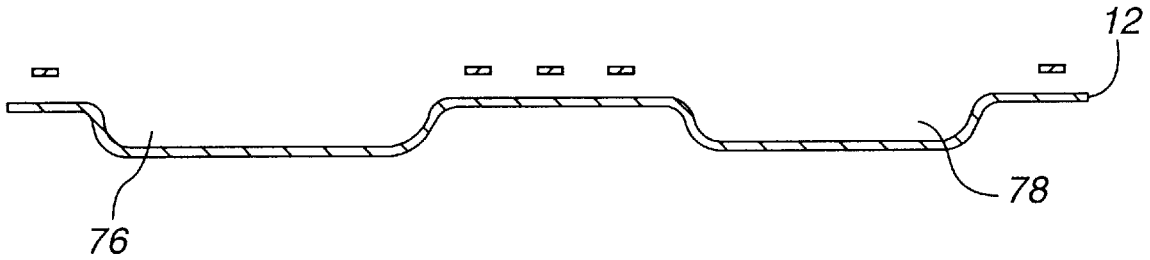

Thin metallic sheet materials can also be used for the ground plane of an antenna in accordance with the present invention. For example, FIG. 8 is a top view of an antenna system 74 illustrating one method of "working" the sheet material to attain higher rigidity. The cross hatched areas in FIG. 8 represent depressions in the ground plane surface. The location of the depressions is chosen so that they will not interfere with the electrical characteristics of the circuitry. For example, the edge of a depressed region should be at least 2 line widths from the edge of any center conductor. Similarly, the edge of the depressed region should be at least 2 line widths from the edge of any antenna elements. FIG. 9 is a sectional side view of the antenna of FIG. 8. The side view corresponds to view C–C' of FIG. 8. FIG. 9 illustrates the depressed regions 76, 78 in the ground plane 12. Alternatively, the depressed regions can be replaced by raised regions.

Figure 10:
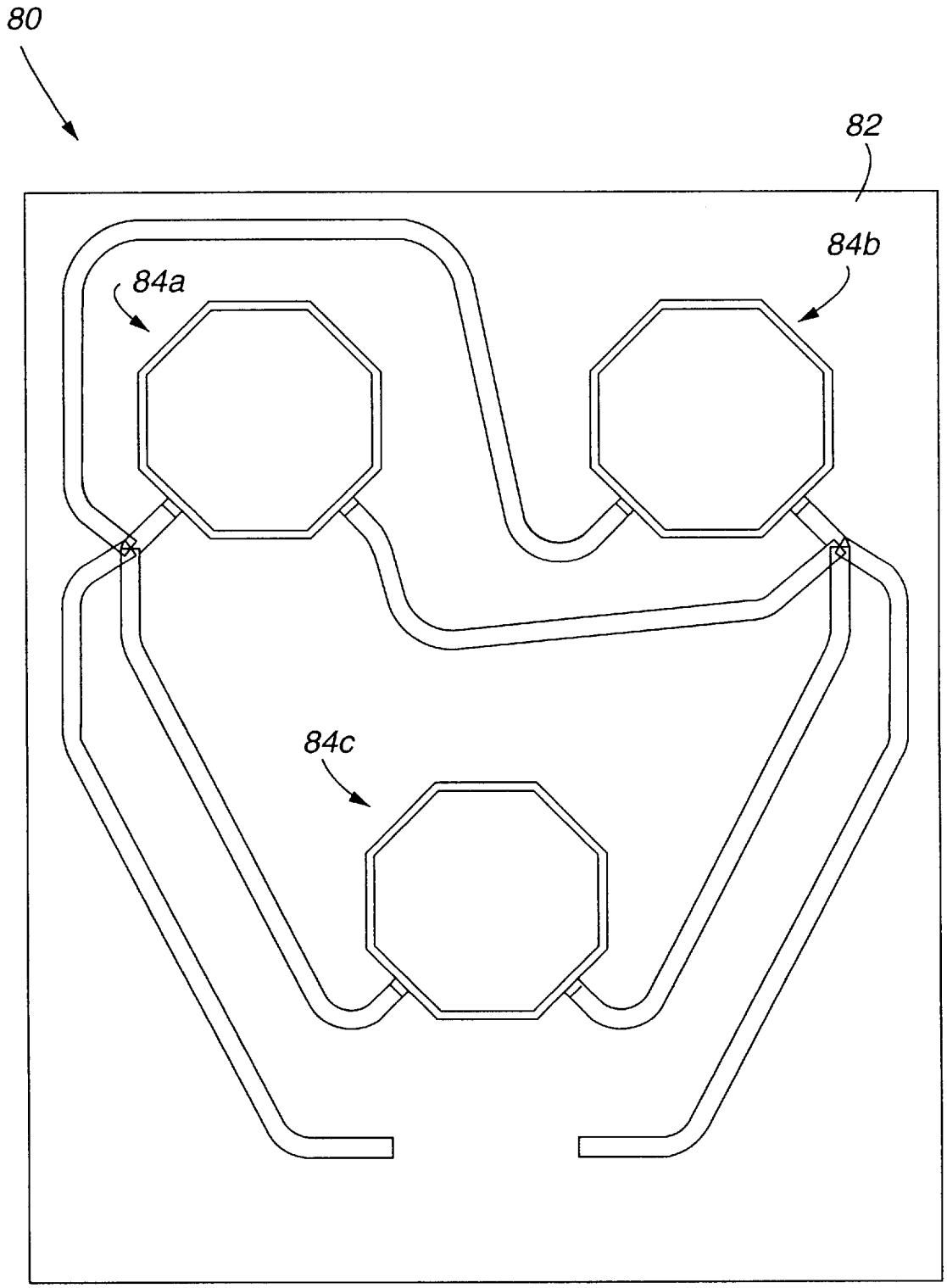
FIG. 10 is a top view of an antenna system having suppressed sidelobes, in accordance with the present invention.

FIG. 10 is a top view of another antenna system 80 in accordance with the present invention. The antenna system 80 provides enhanced sidelobe suppression in the horizontal plane despite the fact that only two antenna elements can fit side by side on the underlying ground plane 82. The dimensions of the ground plane 82 are limited by system constraints. The antenna system 80 achieves the enhanced sidelobe suppression using equal power splits in the divider/combiner structures.

The system 80 includes three "stacked patch" antenna elements 84*a*–84*c* such as the ones described earlier. In conceiving of the present invention, it was appreciated that a microstrip patch radiating element can be modelled as a pair of slot radiators located at opposing edges of the patch. That is, one slot radiator is located at the driven edge and the other slot radiator is located at the edge opposite the driven edge. It was discovered that this dual slot property can be utilized to achieve amplitude tapering in the horizontal plane (and, therefore, sidelobe suppression in this plane) by properly aligning the three patches 84*a*–84*c*. In addition, the amplitude tapering can be achieved using equal power splits.

Figure 11:
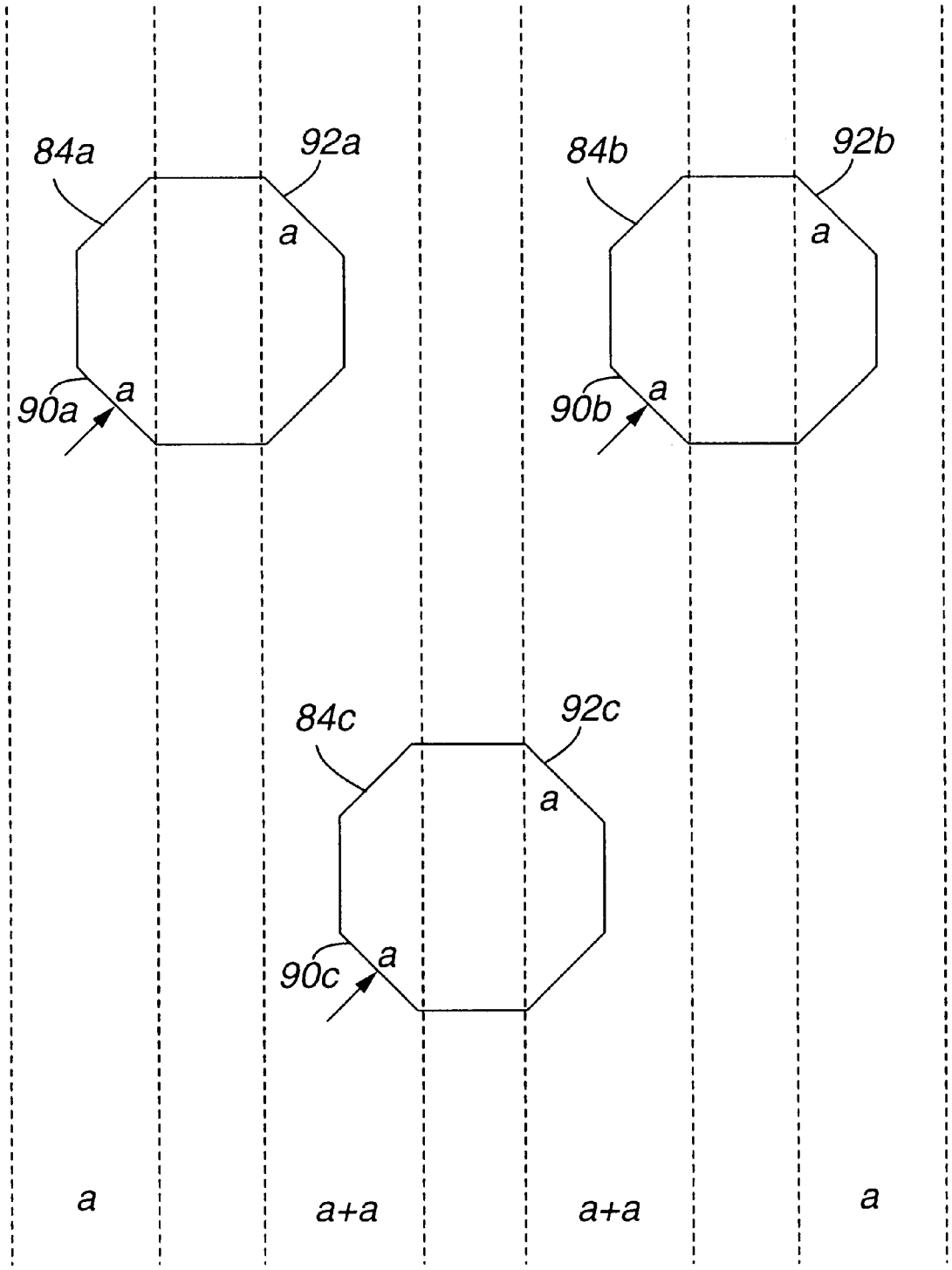
FIG. 11 is an illustration showing how amplitude tapering is achieved in the antenna system of FIG. 10 in accordance with the present invention.

FIG. 11 illustrates the amplitude tapering for the system 80 of FIG. 10. For convenience, the analysis will be made with respect to a slant 45 polarization, rather than dual slant 45. It should be appreciated, however, that the same result is achieved using dual slant 45 polarization. As shown in FIG. 11, each antenna element 84*a*–84*c* has a driven edge 90*a*–90*c* and an edge 92*a*–92*c* opposite the driven edge. As discussed above, these edges act as individual slot radiators when the element is excited. If all of the elements 84*a*–84*c* are driven at the same level, than the signal amplitudes at all of the edges 90*a*–90*c* and 92*a*–92*c* will be the same (i.e., a).

Figure 13:
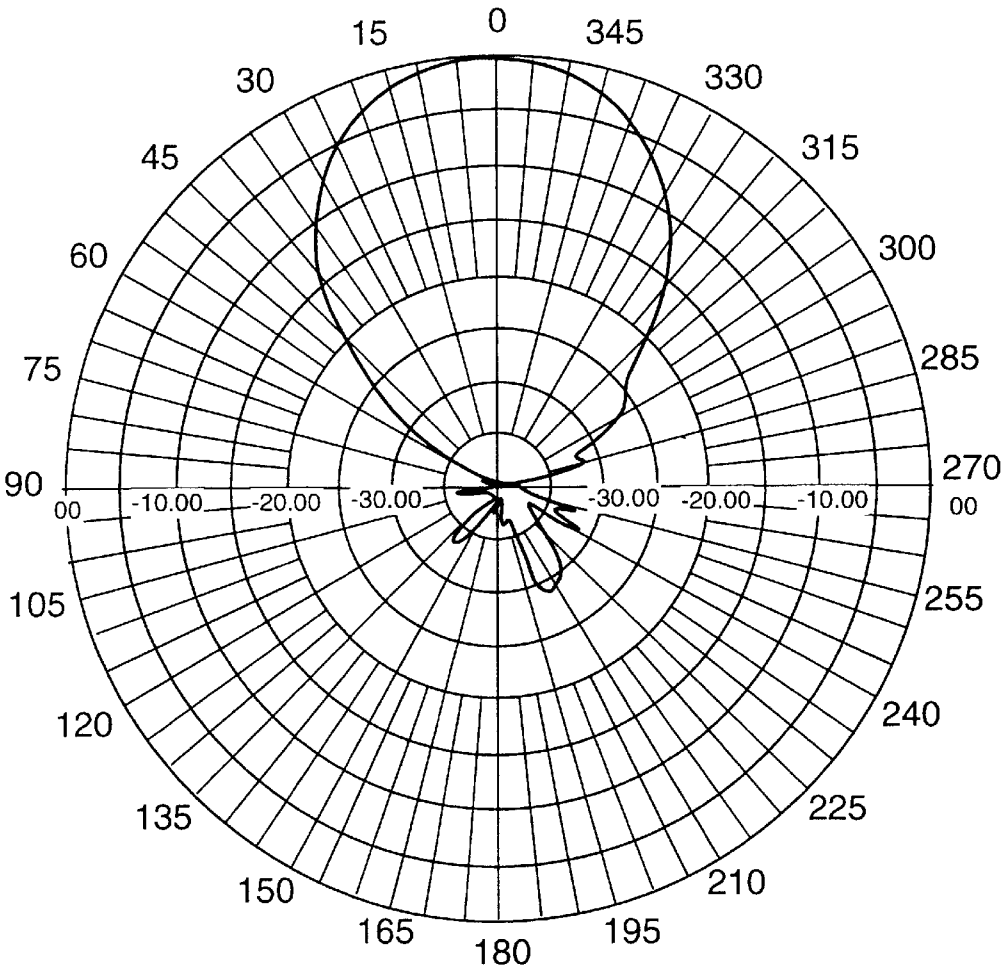
FIG. 13 is a graph illustrating an antenna pattern achieved using the principles of the present invention.

The antenna elements 84*a*–84*c* are arranged so that the opposing edge 92*a* of element 84 is substantially aligned with the driven edge 90*c* of element 84*c* in the vertical direction. Similarly, the opposing edge 92*c* of element 84*c* is substantially aligned with the driven edge 90*b* of element 84*b* in the vertical direction. This arrangement creates an excitation profile in the horizontal direction that has a binomial taper (although, because there is no peak center excitation, it is not an ideal binomial taper). That is, the aligned excitations add in the horizontal plane to create an excitation profile of {a, 2a, 2a, a}. Theoretically, this excitation profile produces sidelobes levels that are 26.5 dB below the peak of the main lobe. These sidelobe levels are more than 13 dB lower than those obtained using a uniform excitation profile. FIG. 13 illustrates a measured antenna pattern for an antenna that was designed using the techniques of the present invention.

It should be appreciated that the aligned edges do not have to be perfectly aligned in the vertical direction to achieve sidelobe suppression, but only need to be substantially aligned. That is, the level of alignment must be enough so that the excitation levels appear to be originating from a single location in the horizontal plane and thus "add".

Figure 12:
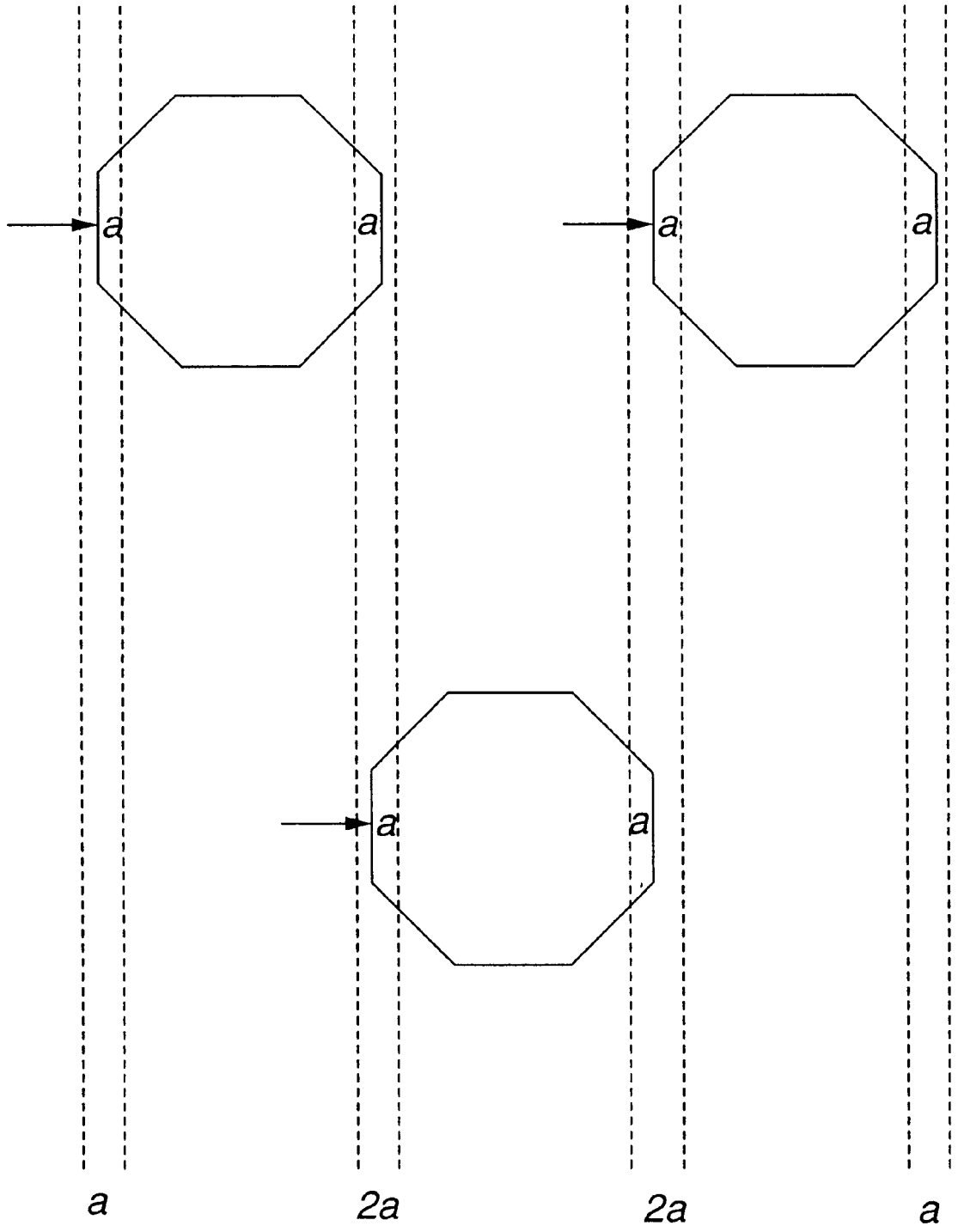
FIG. 12 is an illustration showing how amplitude tapering is achieved in an antenna system using horizontal polarization in accordance with the present invention.

As illustrated in FIG. 12, the same principles discussed above with respect to slant 45 polarization can be applied to a system using horizontal polarization. In addition, the techniques may be used with elements other than microstrip patch elements, such as, for example, dipole pairs or other elements where a single feed creates two equal excitation levels.

In one embodiment of the present invention, the parasitic patch elements are mounted on the radome rather than the antenna element itself. The parasitic elements can be suspended from the inner surface of the radome using fasteners, can be plated onto the inner or outer surface of the radome, or can be embedded into the radome during the molding thereof. In another approach, the entire driver circuit layer and/or ground plane is molded into the radome. This method eliminates the need for fasteners to achieve the proper spacings. Other arrangements are also possible.

Although the present invention has been described in conjunction with its preferred embodiments, it is to be understood that modifications and variations may be resorted to without departing from the spirit and scope of the invention as those skilled in the art readily understand. For example, the inventive concepts are not limited to use with stacked patch antenna elements and work equally as well with virtually any type of antenna element. Such modifications and variations are considered to be within the purview and scope of the invention and the appended claims.

What is claimed is:

1. An antenna system, comprising:

a ground plane;

a plurality of radiating elements being parallel to substantial portions of said ground plane, said plurality of radiating elements including at least a first radiating element, a second radiating element, and a third radiating element, said first, second and third radiating elements being located in at least two columns and two rows;

a first set of transmission line sections having lengths and all of said lengths being spaced from and being parallel to substantial portions of said ground plane, said first set of transmission line sections including at least a first transmission line section, a second transmission line section, and a third transmission line section, said first, second and third transmission line sections of said first set being directly interconnected wherein said first, second and third transmission line sections form a continuous feed structure in which said first, second and third transmission line sections of said first set are uninterrupted by said first, second and third radiating elements and in which:

said first transmission line section of said first set is connected to a first portion of said first radiating element;

said second transmission line section of said first set is connected to a first portion of said second radiating element;

said third transmission line section of said first set is connected to a first portion of said third radiating element, wherein said first radiating element, said second radiating element and said third radiating element are interconnected using said first, second and third transmission line sections of said first set;

means for coupling energy including a first connector, a first distance being defined from said first connector to said first radiating element along at least said first transmission line section of said first set, a second distance being defined from said first connector to said second radiating element along at least said second transmission line section of said first set and a third distance being defined from said first connector to said third radiating element along at least said third transmission line section of said first set and in which said first distance is different from at least one of said second distance and said third distance; and a second set of transmission line sections having lengths and all of said lengths being spaced from and being parallel to substantial portions of said ground plane, said second set of transmission line sections including a first transmission line section, a second transmission line section and a third transmission line section, said first, second and third transmission line sections of said second set being directly interconnected wherein said first, second and third transmission line sections of said second set form a continuous feed structure in which said first, second and third transmission line sections of said second set are uninterrupted by said first, second and third radiating elements and in which:

said first transmission line section of said second set is connected to a second portion of said first radiating element;

said second transmission line section of said second set is connected to a second portion of said second radiating element;

said third transmission line section is connected to a second portion of said third radiating element and in which said first radiating element, said second radiating element and said third radiating element are interconnected using said first, second and third transmission line sections of the said second set;

wherein said plurality of radiating elements, said first set of transmission line sections and said second set of transmission line sections define a conductive circuitry layer that is a single piece formed from a single sheet of conductive material having substantially uniform composition and in which all of said plurality of radiating elements are in a common plane.

2. The antenna system of claim 1, wherein:

all of said first and second sets of transmission line sections are substantially in said common plane.

3. The antenna system of claim 1, wherein:

portions of said transmission line sections of said first set are curved.

4. The antenna system of claim 1, wherein:

at least one of said first, second and third transmission line sections of said first set has portions that are non-linear and at least one of said first, second and third transmission line sections of said second set has portions that are non-linear.

5. The antenna system of claim 1, wherein:

each of said first, second and third radiating elements has a center, with a center straight line being defined that extends through said centers of said first and second radiating elements and in which any extension that continues said center straight line is unable to pass through said center of said third radiating element.

6. The antenna system of claim 1, wherein:

each of said first, second and third radiating elements has a center with a first, second and third center straight lines that bisect said first, second and third radiating elements, respectively, to define first and second half sections for each of said first, second and third radiating elements, each of said first, second and third transmission line sections contacting one of said first, second and third radiating elements at a contact area defined as a first contact area, a second contact area and a third contact area, respectively, with said first and second contact areas being in a first half section spaced from said center lines thereof and said third contact area being in said second half section and spaced from said third radiating element center line.

7. The antenna system of claim 1, wherein:

said means for coupling energy includes a second connector, a fourth distance being defined from said second connector to said first radiating element along at least said first transmission line section of said second set, a fifth distance being defined from said second connector to said second radiating element along at least said second transmission line section of said second set and a sixth distance being defined from said second connector to said third radiating element along at least said third transmission line section of said second set and in which said fourth distance is different from at least one of said fifth distance and said sixth distance.

8. The antenna system of claim 1, wherein:

said first distance and said second distance are substantially different from said third distance.

* * * * *